United States Patent [19]

Barnard

[11] Patent Number: 4,775,016

[45] Date of Patent: Oct. 4, 1988

[54] DOWNHOLE PRESSURE FLUCTUATING FEEDBACK SYSTEM

[75] Inventor: Louis H. Barnard, Pasadena, Tex.

[73] Assignee: Hughes Tool Company - USA, Houston, Tex.

[21] Appl. No.: 102,173

[22] Filed: Sep. 29, 1987

[51] Int. Cl.[4] ..... E21B 7/24

[52] U.S. Cl. ..... 175/56; 137/804; 166/249

[58] Field of Search ..... 175/56; 166/249; 137/804, 826, 835, 838

[56] References Cited

U.S. PATENT DOCUMENTS

| | | | |
|---|---|---|---|
| 3,405,770 | 10/1968 | Galle et al. | 175/56 |
| 3,415,330 | 12/1968 | Bouyoucos | 175/56 |
| 3,441,094 | 4/1969 | Galle et al. | 175/56 |
| 3,450,217 | 6/1969 | Wise | 175/56 |
| 3,532,174 | 10/1970 | Diamantides | 175/56 |
| 3,648,786 | 3/1972 | Chenoweth | 175/56 |
| 3,648,787 | 3/1972 | Chenoweth et al. | 175/56 |
| 3,850,135 | 11/1974 | Galle | 175/56 X |
| 3,860,902 | 1/1975 | Galle | 175/56 X |
| 3,896,889 | 7/1975 | Bouyoucos | 175/56 X |
| 4,630,689 | 12/1986 | Galle et al. | 175/56 |

*Primary Examiner*—Jerome Massie
*Assistant Examiner*—John F. Letchford
*Attorney, Agent, or Firm*—Robert A. Felsman

[57] ABSTRACT

An improved feedback system for use with an oscillator carried in a bore hole is provided. The feedback system connects the output legs of a well bore oscillator to the feedback nozzles of the oscillator. It consists of a detachable housing that contains two compliance chambers. Each chamber has a supply port and an exhaust port. Inertance passageways allow fluid to pass through each chamber.

8 Claims, 7 Drawing Sheets

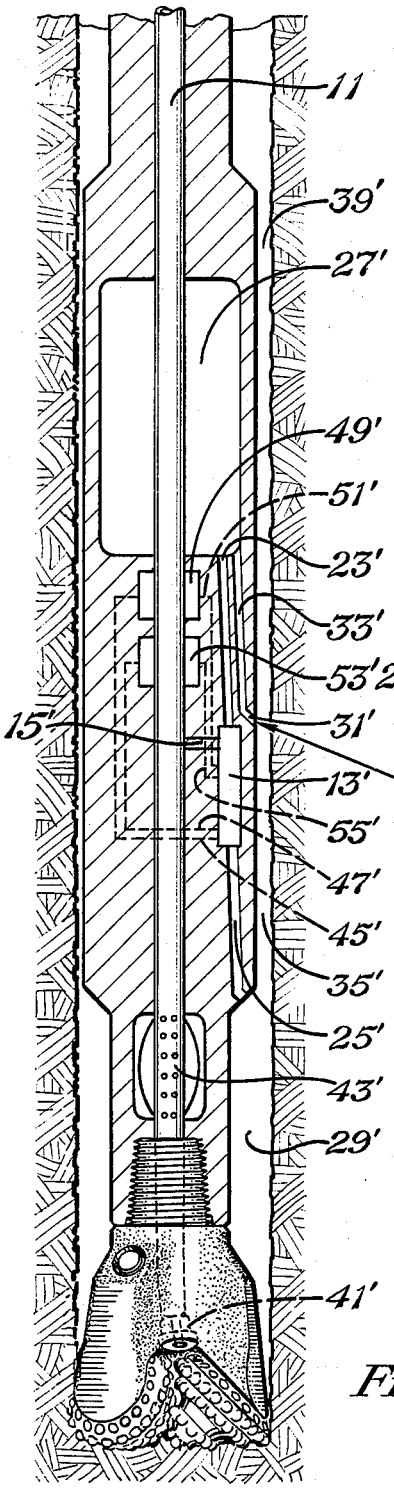
Fig.2
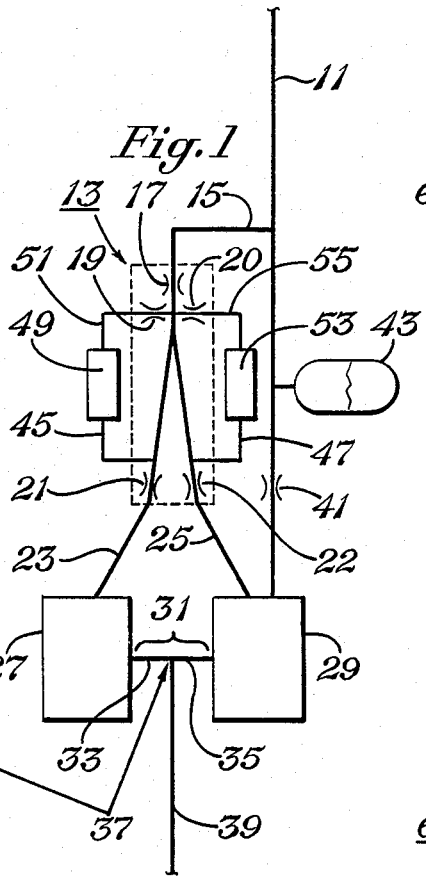
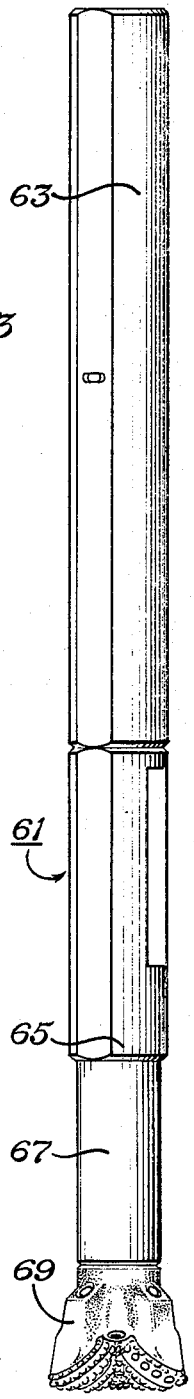
Fig.3

DOWNHOLE PRESSURE FLUCTUATING FEEDBACK SYSTEM

BACKGROUND OF THE INVENTION

1. Field of the Invention

This invention relates generally to pressure fluctuating tools used in well bores, and specifically to an improved downhole pressure fluctuating feedback system that regulates the frequency of oscillation of a downhole oscillator.

2. Description of the Prior Art

It is known in the art to provide pressure variations in the drilling fluid to enhance the drilling rate. Edward M. Galle, et al, U.S. Pat. No. 3,405,770 discloses a system whereby a well bore oscillator is used to provide pressure fluctuations in the drilling fluid. A feedback system is provided to regulate the frequency of oscillation. In Edward M. Galle, et al, the feedback system comprises two compliance cavities that are formed by drilling two holes parallel to the axial bore of the tubular member which carries the oscillator assembly. These two compliance cavities are connected to the output legs of the oscillator and to the feedback nozzles of the oscillator by way of four inertance passageways.

Edward M. Galle, et al. U.S. Pat. No. 4,630,689, discloses an improvement to U.S. Pat. No. 3,405,770. In this improvement, the compliance cavities in the body of the tubular member in U.S. Pat. No. 3,405,770 are replaced by a pair of U-shaped tubes. However, these tubes are subject to fatigue failures.

SUMMARY OF THE INVENTION

An improved downhole pressure fluctuating feedback system for use in a well bore is provided. A detachable housing resides within the tubular member. This housing is separated into two sealed compliance chambers. Each chamber has a supply port and an exhaust port, allowing fluid to enter and exit the compliance chamber.

A first and second supply passage allow fluid to flow from the first and second output legs of the fluid oscillator into the compliance chamber through the supply ports. A first and second exhaust passage allow fluid to flow from the first and second compliance chambers through the exhaust port and to the first feedback nozzle of the fluid oscillator.

BRIEF DESCRIPTION OF THE DRAWINGS

FIG. 1 is a schematic representation of the improved acoustical circuit and elements of the invention.

FIG. 2 is a representation of the lower portion of a downhole tool which embodies the acoustical circuit and elements of the invention in a configuration used to enhance drilling.

FIG. 3 is a side view of the downhole pressure fluctuating tool, coupled with a drill bit in the earth boring configuration.

DESCRIPTION OF THE PREFERRED EMBODIMENT

Figure 4:
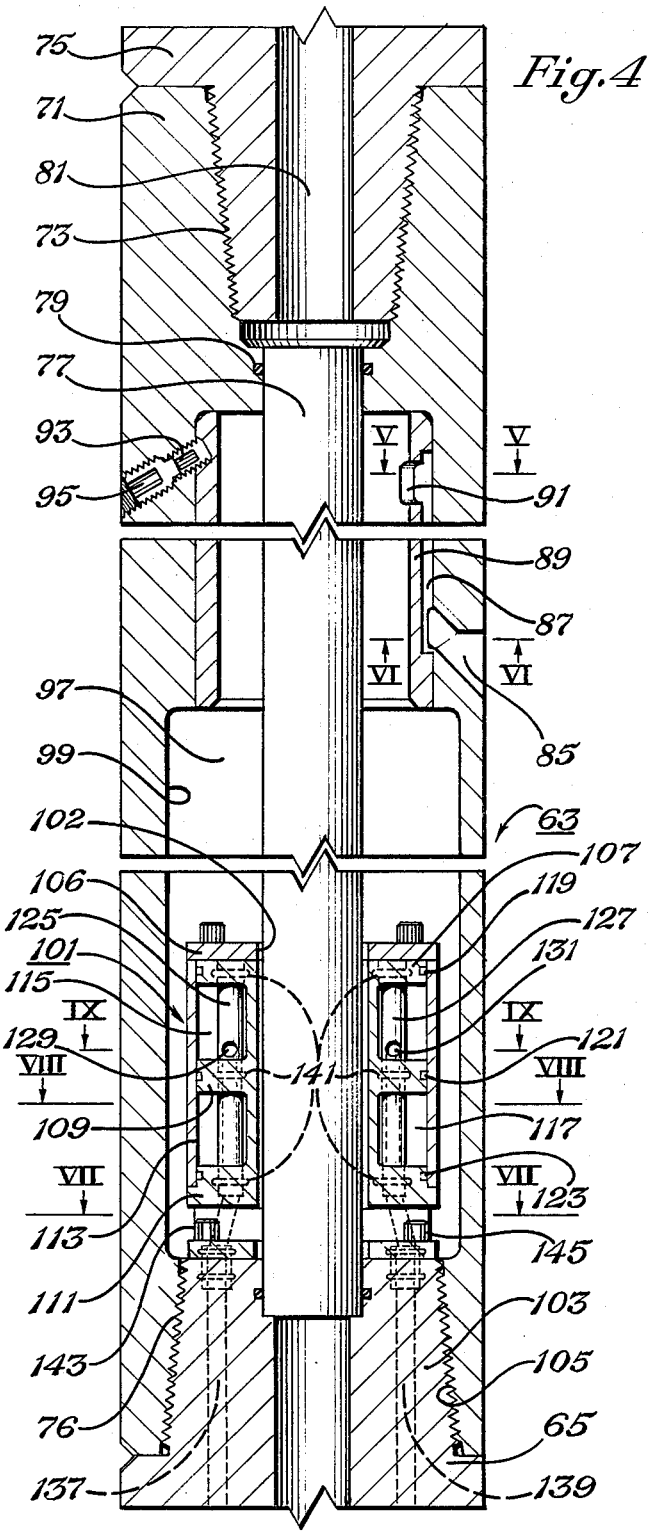
FIG. 4 is a side elevation view, in longitudinal section, of a tool cavity subassembly used to form the interior acoustical compliance inside the body of the tool.

Referring inititally to FIG. 1 of the drawings, the numeral 11 represents a fluid passage from a remote pump (not shown) that communicates with a bistable fluidic oscillator 13 by way of connecting passage 15.

Bistable fluidic oscillator 13 has five nozzles within it: a power nozzle 17, two feedback nozzles 19, 20 and two output nozzles 21, 22. Power nozzle 17 is located at the input of the bistable fluidic oscillator 13. Output nozzles 21, 22 are at the output of the bistable fluidic oscillator 13 and feed output legs 23, 25.

The bistable fluidic oscillator 13 receives fluid from passage 11 and discharges out-of-phase acoustical energy into output legs 23 and 25. The acoustical energy from output leg 23 is fed into an acoustical compliance formed by tool cavity 27. The acoustical energy from output leg 25 feeds the acoustical compliance provided by bit cavity 29.

The tool cavity 27 and bit cavity 29 are connected by a flow passage 31. The flow passage is comprised of two regions: a first region 33, and a second region 35.

Flow passage 31 serves as an acoustical inertance. At its mid-region it communicates with return flow annulus 39. By design, a pressure node is created in mid-region 37. This pressure node serves to minimize the acoustical energy losses in the annulus. The location of the pressure node depends upon the acoustical values of the flow passage 31, and the cavities 27, 29 and need not be at the center of the passage 31. Thus the term "mid-region" is used to cover a range of locations that can be established for the pressure node.

In addition to the bistable fluidic oscillator 13, fluid passage 11 also communicates with bit cavity 29. This flow of fluid occurs through bit nozzle 41. An acoustical filter 43 is provided to minimize the loss of acoustical energy upward back through fluid passage 11.

Turning now to the feedback mechanism for the bistable fluidic oscillator 13, feedback passage 45 allows fluid to flow from output leg 23 and to enter an upper chamber 49. A second feedback passage 51 then allows the fluid to exit from the upper chamber 49 into feedback nozzle 19. Yet another feedback passage 47 allows fluid to flow from output leg 25 into a lower chamber 53. A second feedback passage 55 allows fluid to exit from this lower chamber 53 into feedback nozzle 20. The feedback nozzles 19, 20 work in unison to switch fluid passing through power nozzle 17 alternately between the two output legs 23, 25.

FIG. 2 has been included to assist the visualization of a downhole tool configuration that contains the above described acoustical circuit and elements. In FIG. 2, the same arabic numerals are used to represent the various circuit components as are used in FIG. 1, except they are followed by a prime sign.

The bistable fluidic oscillator 13' receives fluid from the fluid passage 11' through connecting passage 15'.

This bistable fluid oscillator 13' discharges out-of-phase acoustical energy in to output legs 23', 25'. The output legs 23', 25' are drilled holes in the body of the tool. Output leg 23' connects the fluidic oscillator 13' to an interior tool cavity 27' formed within the body of the tool. Output leg 25' connects the bistable fluidic oscillator 13' to a bit cavity 29' partly defined by the tool exterior and partly by the wall of the bore hole.

Flow passage 31' connects the tool cavity 27' with the bit cavity 29'. This flow passage 31' is formed partly by a drilled hole within the tool which is described as a first region 33', and a second region 35' which is defined by the exterior of the tool and the wall of the bore hole.

In the area where the first region 33' and the second region 35' communicate is a pressure node 37 which is useful in minimizing the acoustical energy losses in the annulus. Bit cavity 29' is also fed by fluid passing through fluid passage 11' that is jetted through bit nozzle 41'. Acoustical filter 43' is useful in minimizing the loss of acoustical energy upward through the fluid passage 11'.

Feedback passages 45', 47' feed an upper chamber 49' and a lower chamber 53', respectively. Feedback passages 51', 55' channel fluid from the upper chamber 49' and lower chamber 53' back to the fluidic oscillator 13'. All the feedback passages serve as acoustical inertances, while the upper chamber 49' and lower chamber 53' serve as acoustical compliancies.

Turning now to FIG. 3, the exterior of the downhole tool 61 that includes each of the above components is shown. This tool can be subdivided into three subassemblies: a tool cavity subassembly 63, an oscillator subassembly 65, and accumulator subassembly 67. Each subassembly or "subs" is threaded for coupling and uncoupling a drill string to the surface and a pump (not shown). The accumulator subassembly 67 is connected by threads (not shown) to a drill bit 69. Each of these subassemblies will be discussed separately and in detail below.

The tool cavity subassembly 63 is illustrated in FIG. 4. It has a tubular body 71 threaded on its upper end at 73 to a drill string member 75. The tool cavity subassembly 63 also has threads 76 on its lower end, by which it is connected to oscillator subassembly 65.

A central tube 77, sealed at 79, extends axially through the tool cavity subassembly 63 for communication with the fluid passage 81 of drill string member 75 that communicates with a pump (not shown) located at the surface for pumping fluids downhole. A tool cavity 97 which functions as a compliance is formed betwen the central tube 77 and an interior cylindrical wall 99 which is fashioned from the metal tubular body 71.

Figure 5:
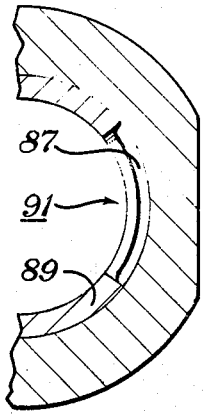
FIGS. 5 and 6 are fragmentary, cross-sectional views as seen looking respectively along the lines V—V and VI—VI of FIG. 4.
Figure 6:
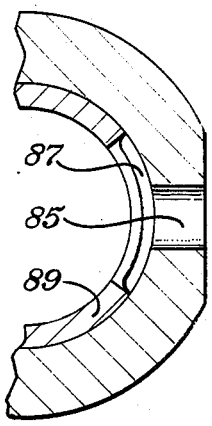

The tool cavity 97 communicates with the annulus through a port 85, a slot 87, formed partially in a sleeve 89 as seen in FIGS. 5 and 6, and an opening 91. The sleeve 89 is held in position by suitable fasteners such as a set screw 93 and pipe plug 95.

FIG. 5 is a fragmentary cross sectional view as seen looking respectively along the lines V—V. This figure illustrates the configuration of sleeve 89, slot 87 and opening 91. FIG. 6 is a fragmentary cross sectional view as seen looking respectively along the lines VI—VI of FIG. 4. This figure illustrates the configuration of port 85, slot 87 and sleeve 89.

Returning now to FIG. 4, the tool cavity 97 functions as an acoustical appliance, and as a housing for removable feedback attachment 101. This removable feedback attachment 101 contains the upper chamber 115 and the lower chamber 117 depicted in acoustical circuit diagram FIG. 1 as 49 and 53 respectively.

This removable feedback attachment 101 mounts onto the pin end 103 of oscillator subassembly 65. This mounting occurs when the oscillator subassembly 65 and the tool cavity subassembly 63 are not yet connected at threads 76 and 105. Only when the subassemblies are connected does the removable feedback attachment 101 reside within tool cavity 97.

Removable feedback attachment 101 is in a cylindrical shape, with a cylindrical hollow center 102. Thus, the removable feedback attachment 101 will slide over the central tube 77 when the tool cavity subassembly 63 and oscillator subassembly 65 are connected.

The removable feedback attachment 101 is made up of several components: cap 106, an upper flange 107, a middle flange 109, lower flange 111 and outer sleeve 113. Flanges 107, 109, 111 are a single machined piece. Outer sleeve 113 slides over the flanges 107,109, and 111. When these pieces are assembled, they define an upper chamber 115 and a lower chamber 117. Where each flange 107, 109, 111 makes contact with the outer sleeve 113, there is a seal: upper seal 119, a middle seal 121, and a lower seal 123. These seals isolate the upper chamber 115 from the lower chamber 117, and prevent any fluid passage between the two chambers.

Four small tubes reside within the removable feedback attachment 101. Since the tool cavity subassembly 63 is in longitudinal section, only two of these tubes appear in FIG. 4. These are supply tube 125 and exhaust tube 127. The supply tube 125 has a supply opening 129, through which fluid enters the upper chamber of 115. The exhaust tube 127 has an exhaust opening 131 through which fluids exists upper chamber 115.

Figure 8:
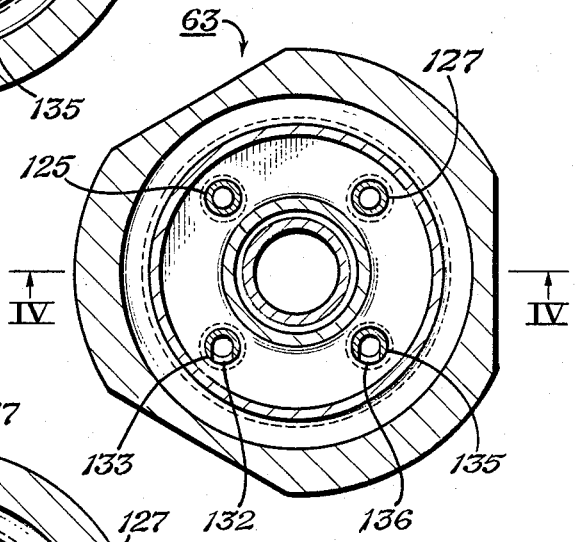

The two tubes not depicted in this longitudinal section but shown in FIG. 8 are second supply tube 133, and second exhaust tube 135. Second supply tube 133 also has a supply opening 132 (not depicted). The second exhaust tube 135 likewise has a second exhaust opening 136 (not depicted). The second supply tube 133 and second supply opening serve to allow fluid passage into lower chamber 117. The second exhaust tube 135, an second exhaust opening 136 serve to allow fluid to exit from the lower chamber 117.

The four supply and exhaust tubes 125, 127, 133, 135, are sealed at tube seals 141 to prevent the passage of fluids between upper chamber 115 and lower chamber 117. When the removable feedback attachment 101 is properly mounted on the pin end 103 of oscillator subassembly 65, the four supply and exhaust tubes 125, 127, 133, and 135, will be aligned with the feedback passages 45, 47, 51, 55 of FIG. 1. Two of these feedback passages are depicted in dashed lined in FIG. 4 as numerals 137 and 139. The removable feedback attachment 101 is both mounted and removed by tightening or loosening bolts 143, 145.

Figure 9:
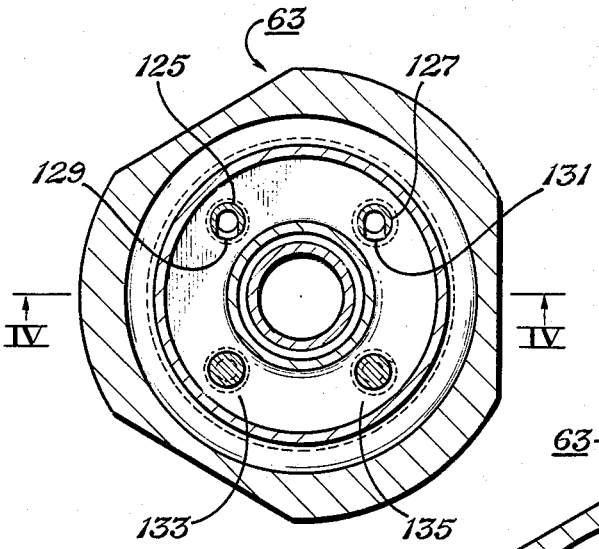
FIGS. 7, 8 and 9 are cross-sectional views as seen looking respectively along the lines through VII—VII, VIII—VIII, and IX—IX of FIG. 4.
Figure 7:
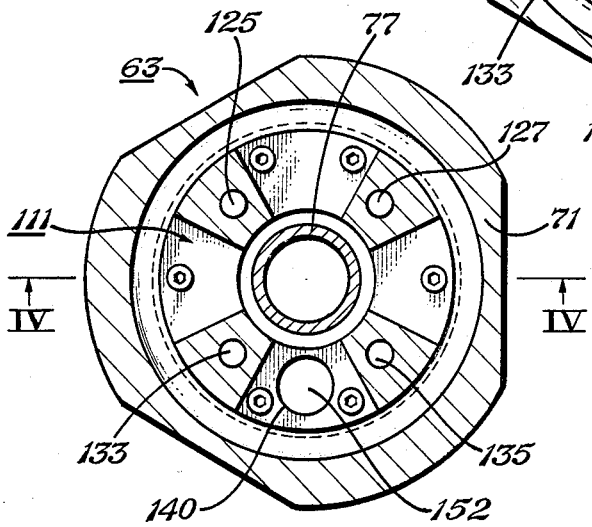

The cross sectional views of FIGS. 7, 8 and 9 will further assist the visualization of the tool cavity subassembly 63 and the removable feedback attachment 101.

FIG. 7 is a cross sectional view as seen along the lines VII—VII of FIG. 4. Revealed by this cross sectional view is lower flange 111 of the removable feedback attachment 101, having four openings to the supply and exhaust tubes 125, 127, 133, 135 that allow the passage of fluid through upper chamber 115 and lower chamber 117. Central tube 77 is also shown. Fluids from a surface pump (not shown) flow downward through the bore of this central tube 77.

Also depicted in FIG. 7 is opening 140 in the lower flange 111 for output leg 152 (numeral 23 of FIG. 1) which connects the tool cavity 97 with the oscillator subassembly 65.

FIG. 8 is a cross sectional view as seen looking along the lines VIII—VIII of FIG. 4. This cross section further depicts the four supply and exhaust tubes 125, 127, 133, 135 and openings 132, and 136 into lower chamber 117 from tubes 133 and 135.

FIG. 9 is a cross sectional view as seen looking along the line IX—IX of FIG. 4. Second supply tube 133 and second exhaust tube 135 are shown as being terminated and sealed. Only supply tube 125 and exhaust tube 127 continue upward into the upper chamber 115. Supply tube 125 has a supply opening 129 that feeds the upper chamber 115. Exhaust tube 127 has an exhaust opening 131 that drains the upper chamber 115.

Figure 10:
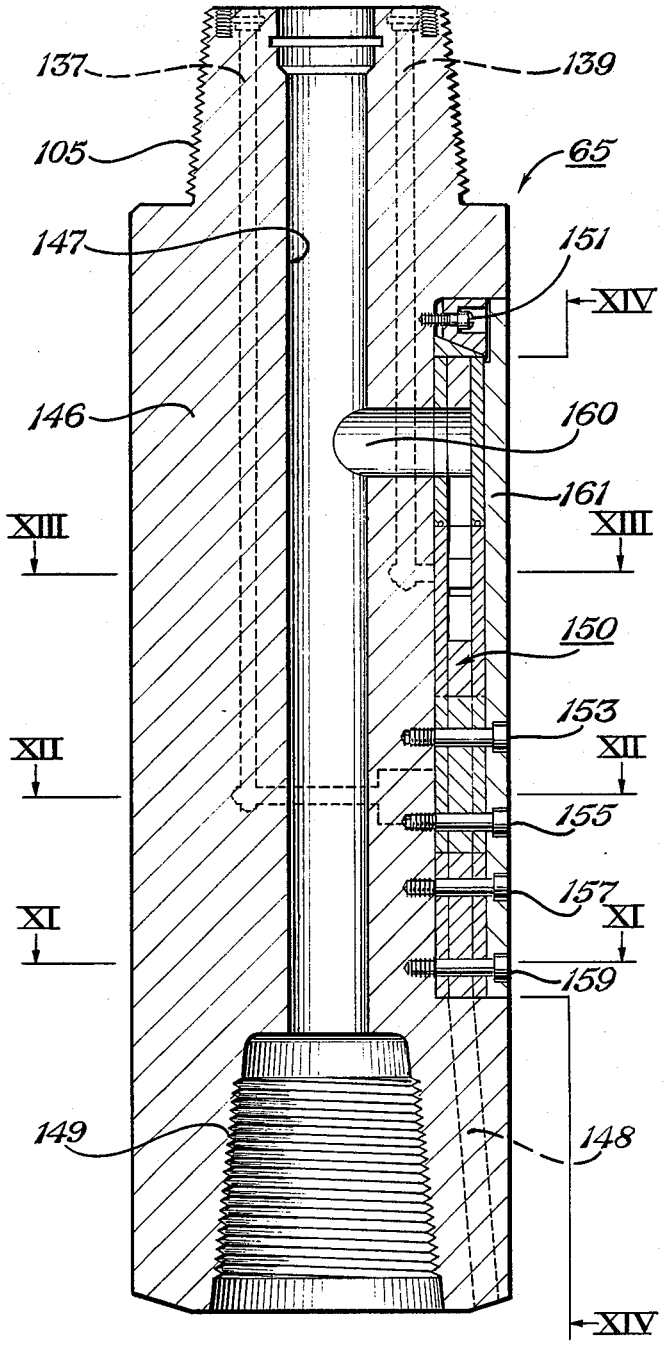
FIG. 10 is a side elevation view, in longitudinal section, of the preferred bistable fluidic oscillator.

Turning now to FIG. 10, the oscillator subassembly 65 will be described in detail. This oscillator subassembly 65 has a tubular body 146 with a central passage 147 that communicates with the central tube 77 of the tool cavity subassembly 63 depicted in FIG. 4. The oscillator subassembly 65 is threaded at 105 on its upper end and 149 on its lower end for connection to the tool cavity subassembly 63 which resides above it, and the accumulator subassembly 67 which resides below it. Drilling fluid that exits the central tube 77 of the tool cavity subassembly 63 will pass through the central passage 147 and into a similar central passage in the accumulator subassembly 67.

Feedback passages 137, 139 are depicted in this Figure. They are useful in communicating with the upper chamber 115 depicted in FIG. 4. Like FIG. 4, FIG. 10 is in longitudinal section. Consequently, two feedback passages 138, 142, numerals 47 and 55 of FIG. 1, are not depicted. These feedback passages can be imagined as being parallel to the two depicted feedback passages 137, 139 directly above the plane of the longitudinal section of FIG. 10. They are useful for communicating with the lower chamber 117 of FIG. 4.

The oscillator subassembly 65 also has an output leg 148 which connects the fluidic oscillator 150 with the bit cavity 29' (See FIG. 2). This output leg 148 corresponds to output leg 25 of FIG. 1.

The bistable fluidic oscillator 150 is held in the subassembly with a plurality of cap screws such as those designated 151, 153, 155, 157, 159, some of which also hold a cover plate 161 over the bistable fluidic oscillator 150.

Connecting passage 160 allows fluid from the central passage 147 to enter the fluidic oscillator 150. Another output leg, not depicted in this longitudinal section of FIG. 10, allows the fluidic oscillator to communicate with the tool cavity 97 of the tool cavity subassembly 63 depicted in FIG. 4. This passage, shown in FIG. 1 as output leg 23, is illustrated in the cross sectional views of FIGS. 12 and 13 as numeral 152.

Figure 12:
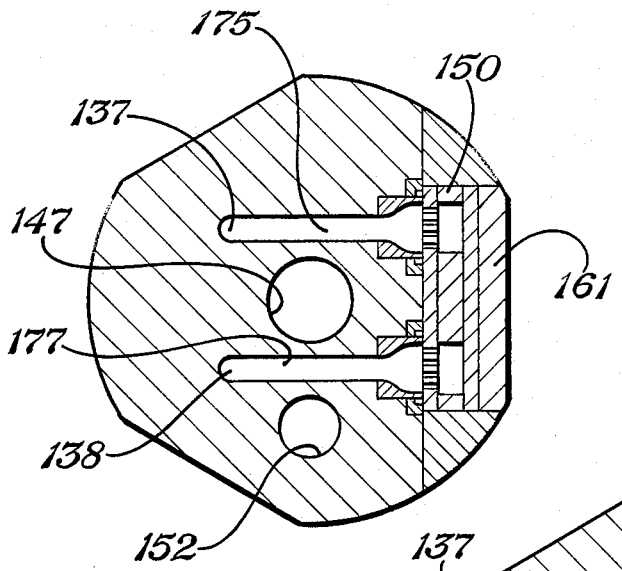
FIGS. 11, 12 and 13 are cross-sectional views as seen looking respectively along the lines XI—XI, XII—XII, and XIII—XIII of FIG. 10.
Figure 13:
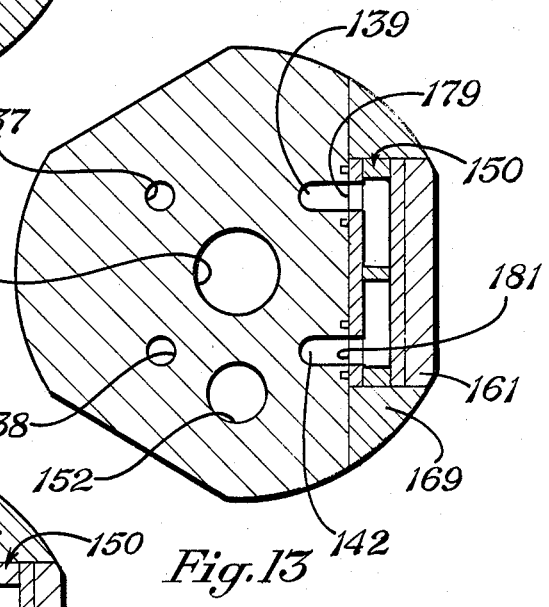
Figure 11:
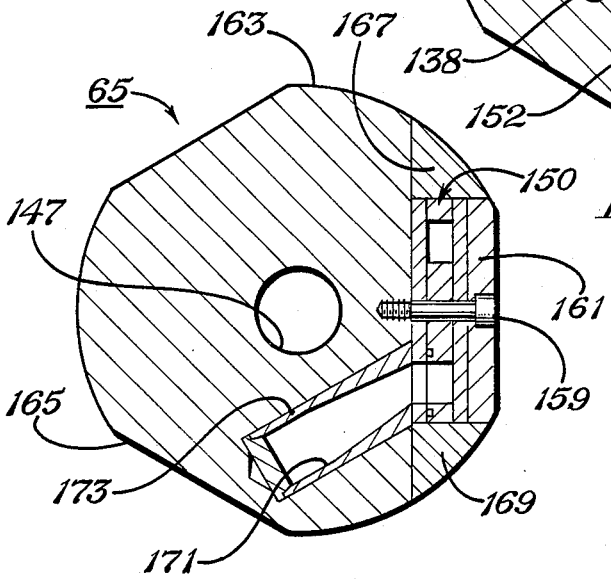

The sectional views of FIGS. 11–13 show additional constructional features of the oscillator subassembly 65. Note that each of these cross sectional views shows the entire cross section of the oscillator subassembly 65, even though they are taken from the longitudinal section of FIG. 10, to simplify and reduce the number of figures of the drawings.

FIG. 11 is a cross sectional view as seen along the lines XI—XI. The exterior of the oscillator subassembly 65 has circular portions 163 and planar portions 165 which cooperate to form one region of the inertance that connects the tool cavity (97 in FIG. 4) to the bit cavity 29' of FIG. 2.

Inside the subassembly 65, concentric to its center line, is a central passage 147 for the passage of fluid from a remote pump (not shown) as previously described. The cap screw 159 is shown securing the cover plate 161 over the bistable fluidic oscillator 150. End plates 167, 169 are also shown. Passage 171 connects the bistable fluidic oscillator 150 to output leg 152. A wear resistant insert 173 lines this passage 171.

FIG. 12 is a cross sectional view as seen looking along lines XII—XII. Again bistable fluidic oscillator 150 is depicted, as well as cover plate 161, and central passage 147. Additionally, this FIG. depicts feedback passages 137, 138 as they communicate with the fluidic oscillator 150 through intersect passages 175, 177.

FIG. 13 is a cross sectional view looking along lines XIII—XIII of FIG. 10. In this Figure feedback passages 137, 138 are shown, as well as output leg 152. Feedback passages 139, 142 are shown communicating with the fluidic oscillator 150 through intersect passages 179, 181.

Figure 14:
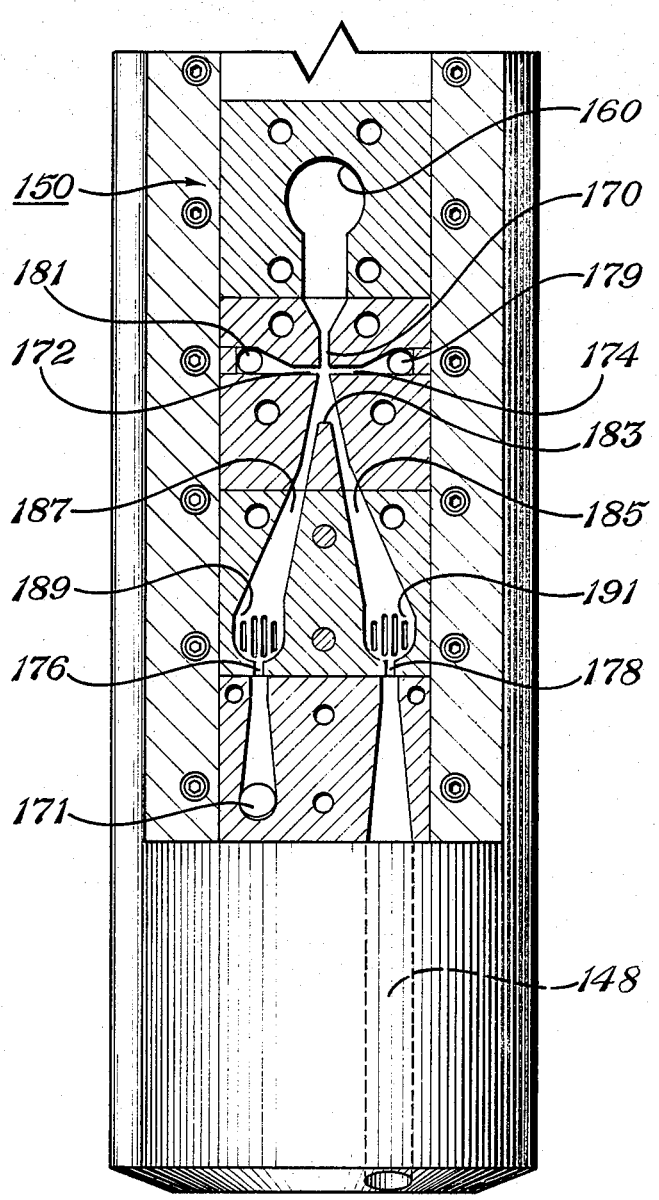
FIG. 14 is a longitudinal section of the oscillator as seen looking along XIV—XIV of FIG. 10.

Turning now to FIG. 14, a closer inspection of the bistable fluidic oscillator 150 will be made. FIG. 14 is a side elevational view partially in longitudinal section of the preferred bistable fluidic oscillator as seen looking along the lines XIV—XIV of FIG. 10.

In this view, the connecting passage 160 is shown opening into the fluidic oscillator 150. This connecting passage 160 allows fluid to flow from the central passage 147. This fluid originated at the surface of the well bore and is pumped down by a pump (not depicted). Fluid entering the bistable fluidic oscillator 150 through connecting passage 160 is directed downward toward power nozzle 170. The fluid is split at splitter 183; part directed down channel 185 and remainder being routed down splitter channel 187. Some fluid is diverted from splitter channel 187 at feedback port 189. This fluid flows through feedback passage 138 (not depicted) to lower chamber (not depicted, numeral 117 of FIG. 4), exiting through feedback passage 142 (not depicted) and into intersect passage 181 shown in FIG. 14.

The fluid that is diverted from splitter channel 185 at feedback port 191 is directed through feedback passage 137 (not depicted) to upper chamber 115 (not depicted), exiting by way of feedback passage 139 (not depicted) and connecting to intersect passage 179 as shown in FIG. 14. The quantities of fluid that exit from the fluidic oscillator 150 through feedback ports 189, 191 and are fed back into the fluidic oscillator 150 at intersect passages 181, 179 and are forced through feedback nozzles 172, 174, numerals 19, 20 in FIG. 1. These nozzles will direct the flow of fluid through splitter 183, affecting the amounts of fluids diverted into splitter channels 185, 187.

The fluid that is not diverted from splitter channels 185, 187 at feedback ports 189, 191 is directed downward through output nozzles 176, 178 into output legs 152 (not depicted), 148. Splitter channel 187 feeds into output leg 152 (not depicted) by way of passage 171. See FIG. 11 for a different view of passage 171.

Figure 15:
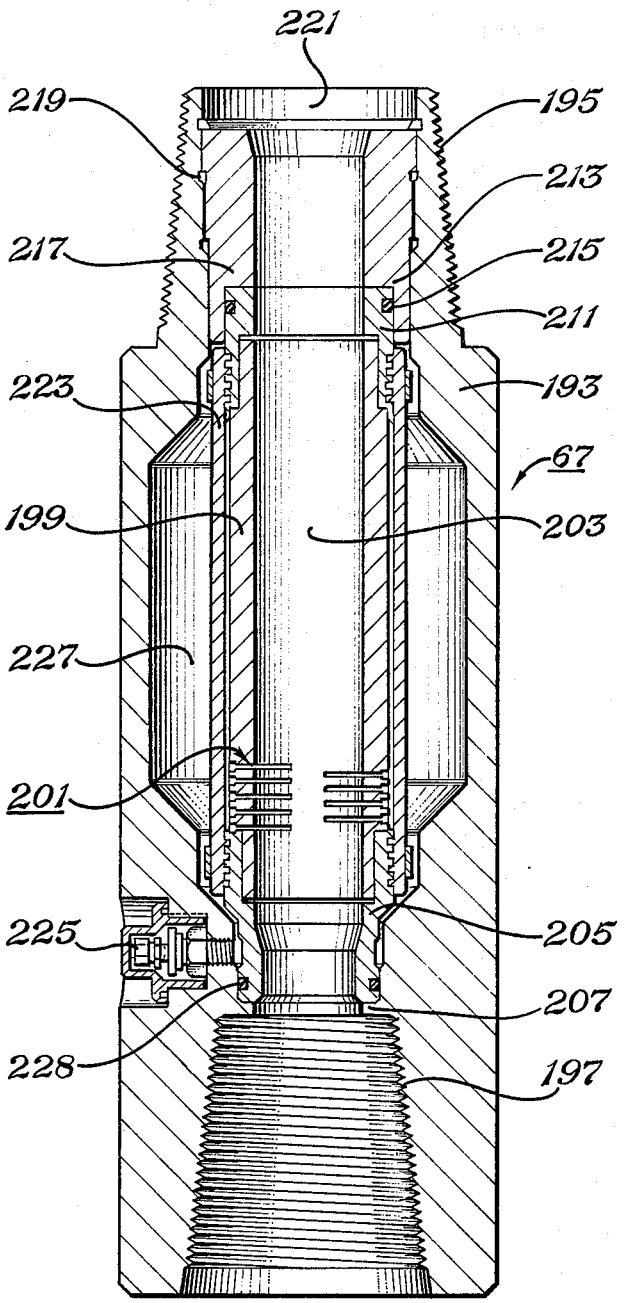
FIG. 15 is a side elevation view, in longitudinal section, of an acoustical filter subassembly which minimizes loss of acoustical energy up the bore of the tool.

The accumulator subassembly 67 is shown in FIG. 15 and is similar to off-the-shelf pressure desurgers such as that which is known as the "Bethlehem Hydraulic Desurger" manufactured by Bethelem Corporation. In the modified form shown in FIG. 15, the accumulator has a body 193 threaded at its upper end as indicated by the numeral 195, for connection to the oscillator subassembly 65, and its lower end it has threads 197 to receive a drill bit.

A mandrel 199, slotted at 201 to communicate with fluid flowing through the subassembly central passage 203, is held inside the body 193 with a lower nipple 205, seated on a shoulder 207 in a lower portion of the body and sealed at 228. The upper end of the mandrel 199 is held by an upper nipple 211, which engages a shoulder 213 and is sealed at 215 against a retainer cap 217, sealed at 219 to the body 193. A resilient snap ring 221 maintains the mandrel 199, nipples 205, 211 and the retainer cap 217 in the designated positions.

A tubular and resilient sleeve 223 is bonded at its upper end to the upper nipple 211 and at its lower end to the lower nipple 205. Pressurized gas is fed through a one way valve 225 to adjust the pressure in a reservoir 227 inside the body and exterior to the resilient sleeve to 223. Hence pressure fluctuations inside the passage 203 are absorbed by the resulting changes in the volume and pressure of the gas in reservoir 227.

Returning to FIG. 1, the operation of this improved downhole pressure fluctuating feedback system will be described. Drilling fluid is pumped downward through fluid passage 11 from the surface. Some of the drilling fluid is diverted through connecting passage 15 to bistable fluidic oscillator 13.

The fluid that is not diverted at connecting passage 15 continues down fluid passage 11 through bit nozzle 41 to bit cavity 29. Acoustical filter 43 is provided to minimize the loss of acoustical energy upward back through fluid passage 11.

The fluid diverted through connecting passage 15 to bistable fluid oscillator 13 is routed through power nozzle 17. Next, the fluid is split, part being directed to output leg 23 and part being directed to output leg 25. Feedback nozzles 19 and 20 are provided directly above where the fluid stream is split between output legs 23, 25.

The feedback nozzles 19, 20 operate to direct fluid toward a particular output leg. They work in opposition. Feedback nozzle 19 directs fluid to output leg 25, while feedback nozzle 20 directs fluid to output leg 23.

Fluid is diverted from output leg 23 and routed back to feedback nozzle 19. Likewise, fluid is diverted from output leg 25 and routed back to feedback nozzle 20.

When the flow through output leg 23 is greater than the flow of fluid through output leg 25, the amount of fluid fed back through operation of feedback nozzle 19 increases. This fluid coming through feedback nozzle 19 will operate on the fluid flowing downward through power nozzle 17 to increase the amount of fluid diverted to output leg 25. Accordingly, the amount of fluid flowing down output leg 25 will surpass the amount of fluid flowing through output leg 23.

When this happens, the amount of fluid being fed back through feedback nozzles 20 increases. This increased fluid flow operates upon the fluid being directed through power nozzle 17, and serves to increases the amount of fluid being diverted to output leg 23. In this manner, fluid is switched alternately between output leg 23, 25.

Output leg 23 communicates with tool cavity 27. Output leg 25 communicates with bit cavity 29. The tool cavity 27 and the bit cavity 29 communicate through flow passage 31. The pressure fluctuations created in bit cavity 29 serve to increase drilling efficiency.

The output legs 23, 25 and feedback nozzle 19, 20 are connected by feedback passages that function as acoustical inertances, and cavities that function as acoustical compliancies. Output leg 23 is connected to feedback nozzle 19 by way of feedback passage 45, upper chamber 49, and feedback passage 51. Output leg 25 is connected to feedback nozzle 20 by way of feedback passage 47, lower chamber 53 and feedback passage 55.

The lengths of the various feedback passages 45, 47, 51, 55, the cross sectional area of the feedback passages 45, 47, 51, 55, and the volume of the upper chamber 49 and lower chamber 53 are carefully selected to provide a desired frequency of oscillation. The frequency of oscillation is determined by the following formula:

$$F=(K\times A^{.44}\times Q)/(L^3\times V^{.87})$$

where K is a constant (1.55), A is the cross-sectional area of the inertance tubes in square feet (feedback passages 45,47,51,55 are of equal cross-sectional area), Q is the flow through the oscillator in gallons per minute, L is the length in feet of one pair of feedback passages (45 and 51 or 47 and 55, both pairs are of equal length), and V is the compliance volume of either the upper or lower chamber in cubic feet.

The present invention has several distinct advantages over the prior art.

First, with the present invention a greater compliance cavity volume can be had than in the prior art. This is true because these compliance cavities are not bored into the body of the tubular member.

Second, design flexibility is greatly increased with the present invention. This is so because the compliance housing is both detachable and replaceable. This allows the volume of the compliance cavity to be altered easily by the mere replacement of the housing.

Third, waste is greatly reduced in the present invention. This is so because broken, worn, or leaky housings can be replaced as needed. Thus, the body of the tool may be reused, rather than discarded.

Fourth, the frequency at which the oscillator operates can be easily altered in the present invention. Such frequency can be adjusted to match the particular formations expected in the well bore.

Fifth, with the present feedback system, a smaller amount of fluid is required to initiate the oscillation of the oscillator than in similar prior art feedback systems.

Sixth, the present feedback system allows greater amounts of fluid to be passed through the borehole. Well bore oscillators will oscillate at the design frequency up to a certain fluid level; above this level, oscillators will operate at a substantially higher frequency. The present feedback system allows the oscillator to operate at higher levels of fluid flow than the prior art feedback systems, while oscillating at the desired design frequency.

I claim:

1. An improved feedback system connecting the first and second output legs and the first and second feedback nozzles of a fluid oscillator used in a tubular member in a drill string in a well bore, the improvement comprising:

a tubular member with threaded ends for connection in the drill string, having a storage cavity formed within the body of the tubular member;

a housing, secured within the storage cavity of the tubular member and divided into two chambers, each chamber functioning as an acoustical compliance and having a supply port and an exhaust port for the passage of fluid;

a first supply passage that operates as an acoustical inertance and allows fluid to flow from the first output leg of the fluid oscillator into the first chamber through the supply port;

a first exhaust passage that operates as an acoustical inertance and allows fluid to flow from the first chamber through the exhaust port to the first feedback nozzle of the fluid oscillator;

a second supply passage that operates as an acoustical inertance and allows fluid to flow from the second output leg of the fluid oscillator into the second chamber through the supply port;

a second exhaust passage that operates as an acoustical inertance and allows fluid to flow from the second chamber through the exhaust port to the second feedback nozzle of the fluid oscillator.

2. An apparatus according to claim 1 wherein the housing is releasably secured within the storage cavity of the tubular member.

3. An apparatus according to claim 1 wherein the frequency of oscillation, F, is determined by the following formula:

$$F=(K\times A^{.44}\times Q)/(L^{.3}\times V^{.87})$$

where K is a constant (1.55);

A is the cross-sectional area of one supply or exhaust passage in square feet;

Q is the flow through the oscillator in gallons per minute;

L is the combined length of one supply passage and one exhaust passage in feet; and V is the compliance volume of one chamber in cubic feet.

4. An improved feedback system for connecting the first and second output legs of a fluid oscillator to the first and second feedback nozzles of the fluid oscillator, the oscillator being of the type that is carried by a drill string composed of connected tubular members that are suspended in a well bore, comprising:

a tubular member with an axial bore, having threaded ends for connection in the drill string;

a central tube carried in the axial bore of the tubular member for directing the passage of fluid through the tubular member;

a storage compartment defined by the interior wall of the tubular member and the central exterior wall of the tube;

a housing divided into two sealed chambers, each chamber having a supply port and an exhaust port for the passage of fluid;

a means for releasably securing the housing within the storage compartment;

a first supply passage that operates as an acoustical inertance and allows fluid to flow from the first output leg of the fluid oscillator into the first chamber through the supply port;

a first exhaust passage that operates as an acoustical inertance and allows fluid to flow from the first chamber through the exhaust port to the first feedback nozzle of the fluid oscillator;

a second supply passage that operates as an acoustical inertance and allows fluid to flow from the second output leg of the fluid oscillator into the second chamber through the supply port;

a second exhaust passage that operates as an acoustical inertance and allows fluid to flow from the second chamber through the exhaust port to the second feedback nozzle of the fluid oscillator.

5. An apparatus according to claim 4 wherein the storage compartment is further defined by an adjacent connected tubular member.

6. An apparatus according to claim 4 wherein the central tube is releasably carried by the axial bore.

7. An improved feedback system connecting the first and second output legs and the first and second feedback nozzles of a fluid oscillator used in a tubular member in a drill string in a well bore, the improvement comprising:

a tubular member with an axial bore;

a central tube carried in the axial bore of the tubular member;

a storage recess defined by the interior wall of the tubular member and the exterior wall of the central tube;

a cylindrical housing that has a hollow central core to accommodate the central tube;

a means for releasably securing the cylindrical housing within the storage recess;

a divider means for dividing the housing into a first and second sealed chamber, each chamber operates as an acoustical compliance and is concentric to the central tube having a supply port and an exhaust port;

a first supply passage that operates as an acoustical inertance and allows fluid to flow from the first output leg of the fluid oscillator into the first chamber through the supply port;

a first exhaust passage that operates as an acoustical inertance and allows fluid to flow from the first chamber through the exhaust port to the first feedback nozzle of the fluid oscillator;

a second supply passage that operates as an acoustical inertance and allows fluid to flow from the second output leg of the fluid oscillator into the second chamber through the supply port;

a second exhaust passage that operates as an acoustical inertance and allows fluid to flow from the second chamber through the exhaust port to the second feedback nozzle of the fluid oscillator.

8. An improved feedback system for connecting the first and second output legs of a fluid oscillator to the first and second feedback nozzles of the fluid oscillator, the oscillator being of the type that is carried by a drill string in a well bore, comprising:

a first threaded tubular member with first and second threaded ends, having an axial borehole that is enlarged at the second threaded end;

a central tube of uniform diameter carried in the axial borehole of the first tubular member;

a means for securing the central tube to the tubular member;

a second tubular member having threaded pin and box ends for connection in a drill string;

a cylindrical housing that has a hollow central core to accommodate the central tube;

a divider means for dividing the housing into a first and second sealed chamber, each chamber operates as an acoustical compliance and has a supply port and an exhaust port;

a means for releasably securing the housing to the pin end of the second tubular member;

a compartment means defined by the interior wall of the enlarged axial borehole of the first tubular member, the exterior wall of the central tube, and the pin end of the second tubular member, for receiving the housing when the first tubular member and the second tubular member are connected together in the drill string;

a first supply passage that operates as an acoustical inertance and allows fluid to flow from the first output leg of the fluid oscillator into the first chamber through the supply port;

a first exhaust passage that operates as an acoustical inertance and allows fluid to flow from the first chamber through the exhaust port to the first feedback nozzle of the fluid oscillator;

a second supply passage that operates as an acoustical inertance and allows fluid to flow from the second output leg of the fluid oscillator into the second chamber through the supply port;

a second exhaust passage that operates as an acoustical inertance an allows fluid to flow from the second chamber through the exhaust port to the second feedback nozzle of the fluid oscillator.

* * * * *

UNITED STATES PATENT AND TRADEMARK OFFICE

CERTIFICATE OF CORRECTION

PATENT NO. : 4,775,016

DATED : October 4, 1988

INVENTOR(S) : Louis H. Barnard

It is certified that error appears in the above-identified patent and that said Letters Patent is hereby corrected as shown below:

In Column 2, line 68 change from:
"fluid passage 11'" to "fluid passage 11"

In Column 3, line 18 change from:
"fluid passage 11'" to "fluid passage 11"

In Column 3, line 20-21 change from:
"fluid passage 11'" to "fluid passage 11"

In Column 7, line 17-18 delete the word --"to"-- from the phrase "sleeve to 223"

In Column 8, line 16 change formula form:

"$F = (K \times A^{.44} \times Q)/(L^{3} \times V^{.87})$" to "$F = (K \times A^{.44} \times Q)/(L^{.3} \times V^{.87})$ Signed and Sealed this Sixteenth Day of May, 1989

*Attest:*

*Attesting Officer*

DONALD J. QUIGG

*Commissioner of Patents and Trademarks*